US011365676B2

(12) United States Patent
Ikebe et al.

(10) Patent No.: US 11,365,676 B2
(45) Date of Patent: Jun. 21, 2022

(54) INTERNAL COMBUSTION ENGINE

(71) Applicant: HONDA MOTOR CO., LTD., Tokyo (JP)

(72) Inventors: Yoshiyuki Ikebe, Wako (JP); Makoto Harada, Wako (JP); Fumihiko Matsubara, Wako (JP); Toshiaki Deguchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 314 days.

(21) Appl. No.: 16/497,267

(22) PCT Filed: Mar. 30, 2017

(86) PCT No.: PCT/JP2017/013249
§ 371 (c)(1),
(2) Date: Sep. 24, 2019

(87) PCT Pub. No.: WO2018/179218
PCT Pub. Date: Oct. 4, 2018

(65) Prior Publication Data

US 2020/0318536 A1 Oct. 8, 2020

(51) Int. Cl.
*F02B 77/08* (2006.01)
*F02B 75/16* (2006.01)
(Continued)

(52) U.S. Cl.
CPC ..... *F02B 77/085* (2013.01); *F02B 75/16* (2013.01); *F02B 75/28* (2013.01); *F02B 2075/1824* (2013.01); *F02D 2200/1015* (2013.01)

(58) Field of Classification Search
CPC .... F01B 1/08; F02B 2075/1824; F02B 75/16; F02B 75/24; F02B 75/243; F02B 75/28;
(Continued)

(56) References Cited

U.S. PATENT DOCUMENTS 5,965,806 A * 10/1999 Antcliff ..... G01M 15/06 73/114.26
6,131,547 A * 10/2000 Weber ..... F02D 41/0097 123/406.58
(Continued)

FOREIGN PATENT DOCUMENTS

JP 2510184 Y2 9/1996
JP H10-184434 A 7/1998
(Continued)

OTHER PUBLICATIONS

Machine Translation of JP2000283010A PDF file name: "JP2000283010A_Machine_Translation.pdf" (Year: 2000).*

*Primary Examiner* — Grant Moubry
*Assistant Examiner* — Ruben Picon-Feliciano
(74) *Attorney, Agent, or Firm* — Carrier Blackman & Associates, P.C.; William D. Blackman; Joseph P. Carrier

(57) ABSTRACT

An internal combustion engine includes a crankcase that defines a crank chamber, a crankshaft that has a crank housed in the crank chamber and is rotatably supported on the crankcase, a cylinder block that is joined to the crankcase and defines a plurality of cylinders in a horizontally-opposed arrangement, a to-be-detected body that rotates integrally with the crankshaft, and a detection sensor that extends through the crankcase from an upper face of the crankcase, is made to face a trajectory of the to-be-detected body, and generates a pulse signal in response to movement of the to-be-detected body. Thus, in a so-called horizontally-opposed internal combustion engine, a structure for disposing a detection sensor that can detect the angular velocity of a crankshaft with high precision is provided.

8 Claims, 4 Drawing Sheets

(51) Int. Cl.
*F02B 75/28* (2006.01)
*F02B 75/18* (2006.01)

(58) Field of Classification Search
CPC ..... F02B 77/085; F02B 77/087; F02D 2200/1015; F02D 45/00
See application file for complete search history.

(56) References Cited

U.S. PATENT DOCUMENTS

| | | | | |
|---|---|---|---|---|
| 6,318,320 | B1 * | 11/2001 | Tosaka | F01L 1/024 123/195 HC |
| 2006/0042585 | A1 * | 3/2006 | Sanada | F16F 15/26 123/195 H |

FOREIGN PATENT DOCUMENTS

| | | | | | |
|---|---|---|---|---|---|
| JP | 2000-130174 | A | | 5/2000 | |
| JP | 2000-283010 | A | | 10/2000 | |
| JP | 2000283010 | A | * | 10/2000 | F02N 19/005 |
| JP | 2006-226214 | A | | 8/2006 | |
| JP | 2014-199040 | A | | 10/2014 | |

* cited by examiner

INTERNAL COMBUSTION ENGINE

TECHNICAL FIELD

The present invention relates to an internal combustion engine that includes a cylinder block that is joined to a crankcase and defines a plurality of cylinders in a horizontally-opposed arrangement with cylinder axes displaced by 180 degrees around a reference line.

BACKGROUND ART

Patent Document 1 discloses a pulse sensor. The pulse sensor is made to face an outer rotor of a generator. The outer rotor is fixed to an extremity of a crankshaft. A piece of to-be-detected body is mounted on an outer face of the outer rotor. The pulse sensor detects the to-be-detected body in response to rotation of the outer rotor and generates a pulse signal while synchronizing it with the rotation in response to the to-be-detected body being detected.

Patent Document 2 discloses a ring gear (a to-be-detected body) mounted on a crankshaft of an internal combustion engine, for determining misfiring. The extremity of an eddy current type microdisplacement sensor (detection sensor) opposes an outer peripheral face of the ring gear. The microdisplacement sensor detects a crank angle. The positional relationship between a crank chamber of the internal combustion engine and the microdisplacement sensor is not disclosed.

RELATED ART DOCUMENTS

Patent Documents

Patent Document 1: Japanese Utility Model Registration Publication No. 2510184

Patent Document 2: Japanese Patent Application Laid-open No. 2014-199040

SUMMARY OF THE INVENTION

Problems to be Solved by the Invention

It is desired that when determining misfiring, the angular velocity of a crankshaft is detected with high precision. However, when the outer rotor of a generator plays the role of a ring gear, since the generator is disposed at a shaft end of a crankshaft, the run-out of the crankshaft is large, and the angular velocity of the crankshaft cannot be detected with high precision.

The present invention has been accomplished in light of the above circumstances, and it is an object thereof to provide, in a so-called horizontally-opposed internal combustion engine, a structure for disposing a detection sensor that can detect the angular velocity of a crankshaft with high precision.

Means for Solving the Problems

According to a first aspect of the present invention, there is provided an internal combustion engine comprising a crankcase that defines a crank chamber, a crankshaft that has a crank housed in the crank chamber and is rotatably supported on the crankcase, a cylinder block that is joined to the crankcase and defines a plurality of cylinders in a horizontally-opposed arrangement, a to-be-detected body that rotates integrally with the crankshaft, and a detection sensor that extends through the crankcase from an upper face of the crankcase, is made to face a trajectory of the to-be-detected body, and generates a pulse signal in response to movement of the to-be-detected body.

According to a second aspect of the present invention, in addition to the first aspect, when mounted on a vehicle, the to-be-detected body is disposed between a pair of journals at a rearmost position of the vehicle within the crank chamber, and the detection sensor is disposed on a radially outer side of the to-be-detected body while being directed toward a rotational axis of the to-be-detected body.

According to a third aspect of the present invention, in addition to the first or second aspect, the to-be-detected body is integrated with a crank web of the crank.

According to a fourth aspect of the present invention, in addition to the third aspect, the crank web is formed so as to have a circular outline without having an opening of an oil passage on an outer peripheral edge thereof.

According to a fifth aspect of the present invention, in addition to the fourth aspect, the internal combustion engine comprises a connecting rod that is linked to a piston housed individually in each of the cylinders via a small end and is linked to a crank pin of the crankshaft via a big end connected to the small end by a shaft part, the big end has a first half body that is continuous from the shaft part and a second half body that sandwiches the crank pin between the second half body and the first half body and is fastened to the first half body by a bolt, and the detection sensor is mounted on the crankcase between a vertical plane that includes the rotational axis of the crankshaft and is orthogonal to a cylinder axis of the cylinder and a cylinder that is at the rearmost position of the vehicle.

According to a sixth aspect of the present invention, in addition to any one of the first to fifth aspects, the detection sensor comprises a main body that is inserted into a through hole formed in the crankcase and faces the crank chamber via a detection part at an extremity thereof, a connector that is joined to the main body and is disposed in a space outside the crankcase, and a fastening piece that is joined to the main body and is fastened to an outer face of the crankcase.

Effects of the Invention

In accordance with the first aspect, due to the detection sensor being mounted on the crankcase, the to-be-detected body can be separated from an outer rotor of a generator. Since it is therefore possible to avoid the influence of an electromagnetic force acting between the outer rotor and an inner stator, the angular velocity of the crankshaft can be detected with high precision. Moreover, since the crankcase is sandwiched between the cylinder blocks along a horizontal plane, the detection sensor can be protected by the crankcase and the cylinder block from stones, etc. scattered up from the road. It is possible to prevent the detection sensor from being damaged. In addition, since the detection sensor is mounted from the outside of the crankcase, any increase in the dimensions of the crankcase or a case cover can be avoided.

In accordance with the second aspect, the detection sensor is disposed on the rear side of the vehicle with respect to the crankcase and the cylinder block. Therefore, stones, etc. scattered up from the front of the vehicle when traveling are blocked by the crankcase or the cylinder block and do not reach the detection sensor. Moreover, even when the number of cylinders increases and the length of the crankshaft increases, in an internal combustion engine with a horizontally-opposed arrangement, since vibration and flexure of the crankshaft are suppressed, even if the to-be-detected body is not positioned at a central position in the axial direction, the angular velocity of the crankshaft can be detected with sufficient precision.

In accordance with the third aspect, since it is unnecessary to provide a to-be-detected body (pulser ring) as a separate body, the to-be-detected body can be incorporated into the internal combustion engine without significantly changing the design.

In accordance with the fourth aspect, since the crank web is formed into a circular shape, the reluctor can be disposed with good precision.

In accordance with the fifth aspect, the big end of the connecting rod forms the bearing for the crank pin with the first half body and the second half body. When fastening the first half body and the second half body, an angular body protruding angularly in the radial direction from the bearing is formed on the big end. When the crankshaft is rotating, compared with the angular body of the first half body, the angular body of the second half body approaches the inner wall face of the crankcase. If the detection sensor is disposed between the cylinder and the vertical plane including the rotational axis, the detection sensor can be kept away from the angular body of the second half body. Since sufficient space is ensured between the angular body of the first half body and the inner wall face of the crankcase even when the crankshaft is rotating, interference between the detection sensor and the connecting rod can easily be avoided.

In accordance with the sixth aspect, the detection sensor is merely inserted into the through hole of the crankcase, the detection sensor can easily be fitted into the internal combustion engine, and since it is fastened to the outer face of the crankcase by means of the fastening piece, the sensor can be reliably fixed to the case outer face.

EXPLANATION OF REFERENCE NUMERALS AND SYMBOLS

Figure 1:
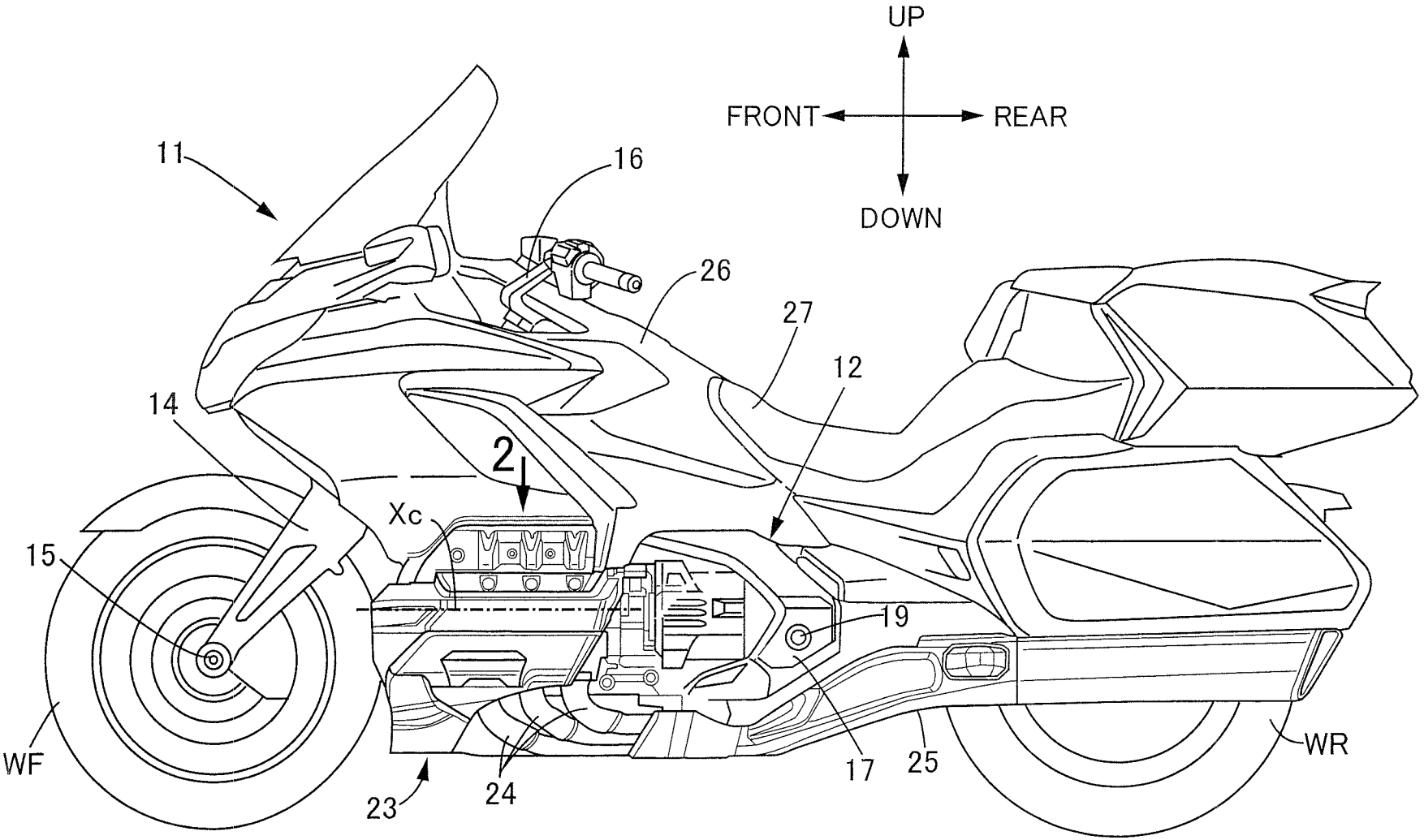
FIG. 1 is a side view schematically showing the overall arrangement of a two-wheeled motor vehicle. (first embodiment)

23 Internal combustion engine
31 Crankcase
32 Crankshaft
33 Cylinder block
33*a* Cylinder (on rear side of vehicle)
35 Piston
37, 37*a* Journal
38 Crank pin
42 Crank web (third crank web)
43 Crank chamber
44 Connecting rod
45 Oil passage
49 Small end
52 Big end
52*a* First half body
52*b* Second half body
53 Shaft part
54 Bolt
61 To-be-detected body (pulser ring)
62 Detection sensor (pulser sensor)
63 Vertical plane
64 Through hole
65 Main body
66 Connector
67 Fastening piece
Xc Rotational axis (of crankshaft)

MODES FOR CARRYING OUT THE INVENTION

One embodiment of the present invention is explained below by reference to the attached drawings. Here, the top and bottom, front and rear, and left and right of a vehicle body are defined based on the point of view of a person riding a two-wheeled motor vehicle.

First Embodiment

FIG. 1 schematically shows the overall arrangement of a two-wheeled motor vehicle related to one embodiment of the present invention. A two-wheeled motor vehicle 11 includes a vehicle body frame 12. A front fork 14 is steerably supported on a head pipe via the front end of the vehicle body frame 12. A front wheel WF is supported on the front fork 14 so that it can rotate around an axle 15. Handlebars 16 are joined to the front fork 14 on an upper side of the head pipe. A swing arm is supported on a pivot frame 17 on a rear side of the vehicle body frame 12 so that it can swing around a support shaft 19 extending horizontally in the vehicle width direction. A rear wheel WR is supported at the rear end of the swing arm so that it can rotate around an axle.

An internal combustion engine 23 is mounted on the vehicle body frame 12 between the front wheel WF and the rear wheel WR. The internal combustion engine 23 is arranged as a horizontally-opposed six cylinder internal combustion engine. The internal combustion engine 23 generates power around a rotational axis Xc extending in the vehicle fore-and-aft direction. The power of the internal combustion engine 23 is transmitted to the rear wheel WR via a power transmission device (not illustrated).

An exhaust pipe 24 is connected to the internal combustion engine 23. An exhaust muffler 25 is connected to the exhaust pipe 24. The exhaust muffler 25 extends from below the internal combustion engine 23 and has an exhaust port disposed to one side of the rear wheel WR. Exhaust of the internal combustion engine 23 is discharged from the exhaust muffler 25.

A fuel tank 26 is mounted on the vehicle body frame 12 above the internal combustion engine 23. A rider's seat 27 is mounted on the vehicle body frame 12 to the rear of the fuel tank 26. Fuel is supplied from the fuel tank 26 to a fuel injection device of the internal combustion engine 23. When driving the two-wheeled motor vehicle 11 the rider straddles the rider's seat 27.

Figure 2:
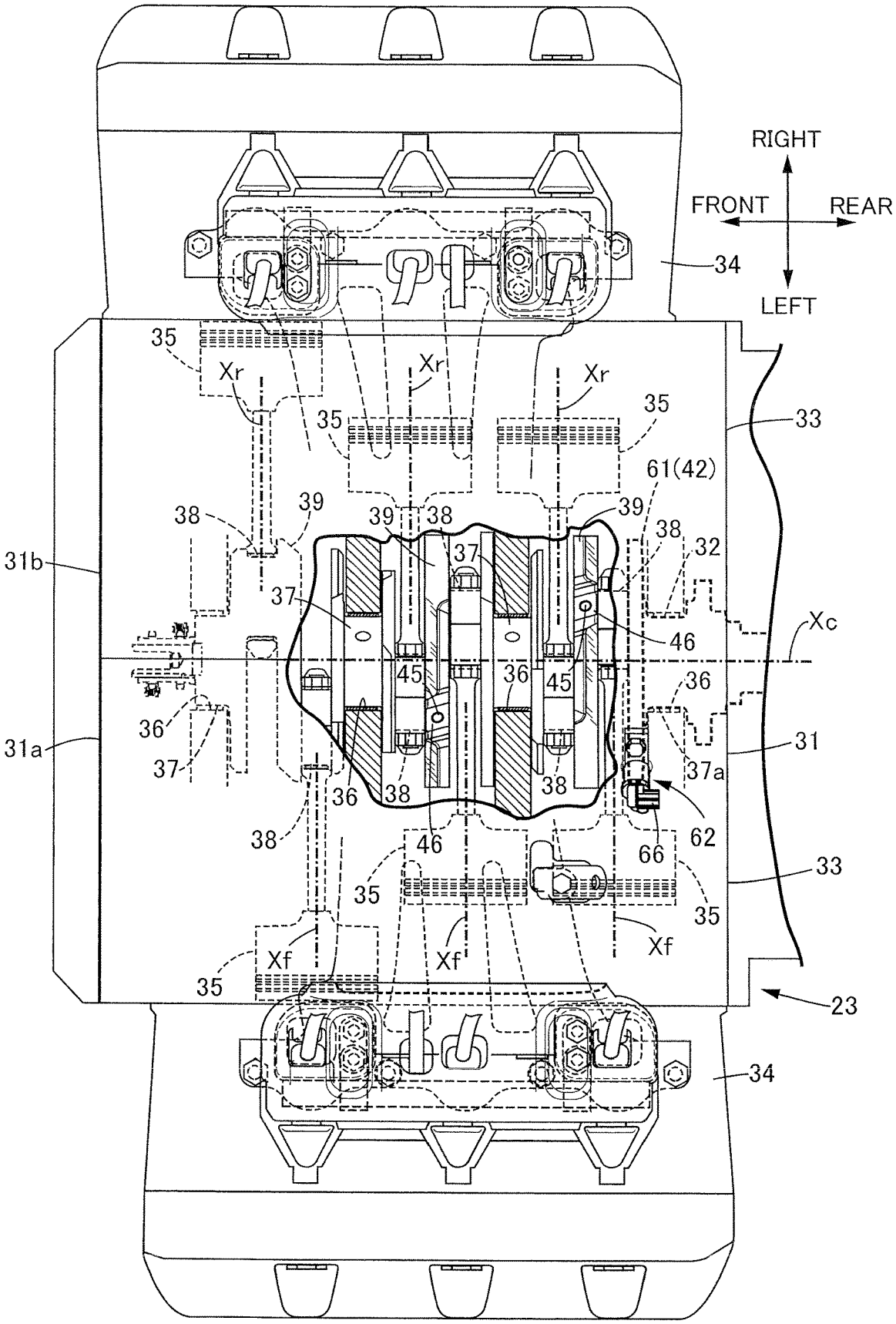
FIG. 2 is an enlarged horizontal sectional view of an internal combustion engine. (first embodiment)

As shown in FIG. 2, the internal combustion engine 23 includes a crankcase 31, a crankshaft 32 supported on the crankcase 31 so that it can rotate around the rotational axis Xc, a cylinder block 33 joined to the crankcase 31 and defining left and right cylinder trains having cylinder axes Xf and Xr that are displaced by 180 degrees around a reference line (center line), and a cylinder head 34 joined to the cylinder block 33 for each cylinder train. The rotational axis Xc of the crankshaft 32 is orthogonal to a virtual vertical plane that includes the axle of the rear wheel WR and is vertical to the ground. The crankcase 31 is divided into a left half body 31*a* and a right half body 31*b* by means of a virtual vertical plane that includes the rotational axis Xc. The cylinder block 33 is integrated with the left half body 31*a* and the right half body 31*b* respectively.

The internal combustion engine 23 includes a piston 35. The piston 35 is housed individually in each of the cylinders. The pistons 35 move to-and-fro along the cylinder axes Xf and Xr. Since the timing of intake, compression, combustion and exhaust is adjusted for each pair of opposing cylinders, vibration accompanying movement of the pistons 35 is suppressed.

The crankshaft 32 includes journals 37 and 37*a* (here there are four) supported on bearings 36 fixed to the crankcase 31 so that they can rotate around the rotational axis Xc, two crank pins 38 disposed between a pair of the journals 37 and 37*a* that are adjacent to each other and having an axis positioned so as to be separated in the radial direction from the rotational axis Xc by a fixed distance, a first crank web 39 disposed between the two crank pins 38 between the pair of journals 37 and 37*a* and linked to the two crank pins 38, a second crank web 41 disposed between the journals 37 and 37*a* and the adjacent crank pin 38 and linked to the journal 37 and the corresponding crank pin 38, and a third crank web 42 positioned at the rearmost position of the vehicle and connected to the journal 37*a* at the rearmost position of the vehicle. The crank is formed from the crank pins 38 and the crank webs 39, 41 and 42. The crank is housed in a crank chamber 43 defined within the crankcase 31. The individual piston 35 and the corresponding crank pin 38 are linked by means of a connecting rod 44. Linear movement of the piston 35 is converted into rotation of the crankshaft 32 by the action of the crank.

The first crank web 39 is formed into a disk shape. An oil passage 45 is formed in some of the first crank webs 39 so as to open on outer peripheral edge. The opening of the oil passage 45 is disposed on a cutout face 46 that is indented toward the radially inner side from the circular outline. The cutout face 46 has a plane that is orthogonal to a straight line extending toward a central part of the journal 37.

Figure 3:
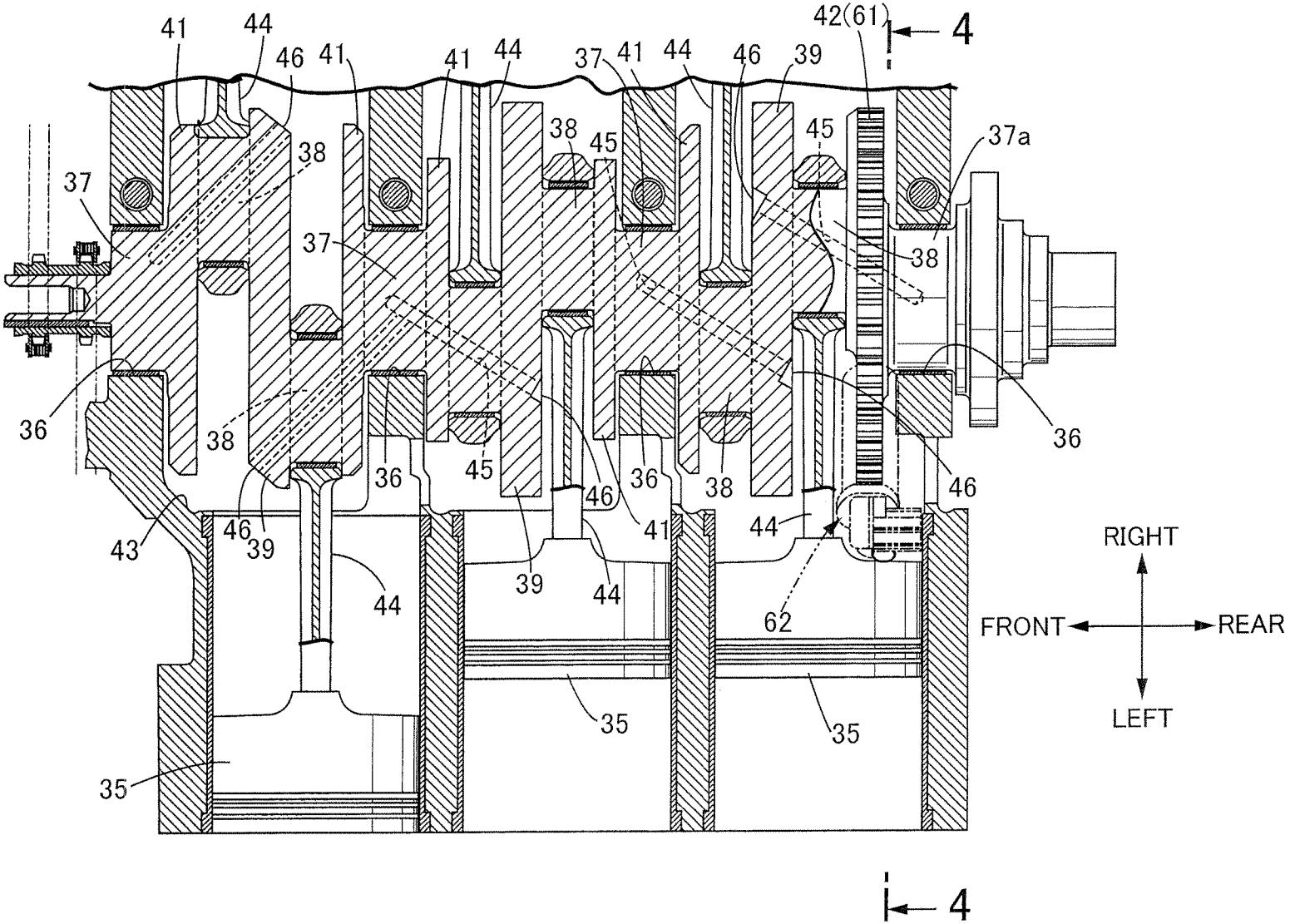
FIG. 3 is an enlarged cross section of part of FIG. 2. (first embodiment)

As shown in FIG. 3, the oil passage 45 extends linearly up to the central part of the journal 37. The oil passage 45 extends outward in the radial direction from the central part of the journal 37 and is connected to the bearing 36. An opening of the oil passage 45, including the cutout face 46, is not formed in the second crank web 41 and the third crank web 42. In the third crank web 42 a cutout is not produced in the circular outline.

Figure 4:
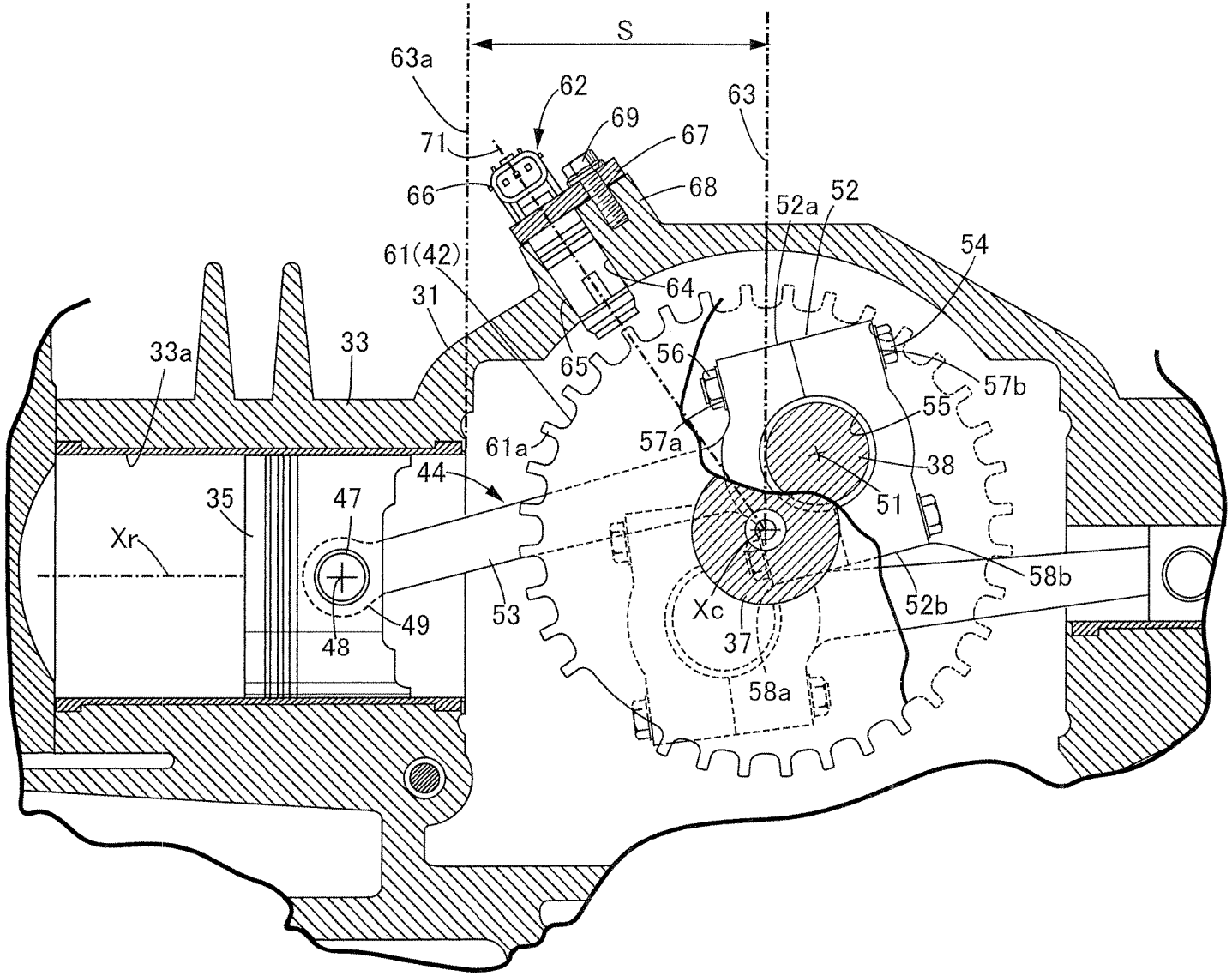
FIG. 4 is an enlarged vertical sectional view of the internal combustion engine along line 4-4 in FIG. 3. (first embodiment)

As shown in FIG. 4, the connecting rod 44 includes a small end 49 linked to a linking shaft 47 within the individual piston 35 so that it can undergo relative rotation around an axis 48, a big end 52 linked to the corresponding crank pin 38 of the crankshaft 32 so that it can undergo relative rotation around an axis 51, and a shaft part 53 connecting the small end 49 and the big end 52 to each other.

The big end 52 has a first half body 52*a* continuous from the shaft part 53 and a second half body 52*b* sandwiching the crank pin 38 between itself and the first half body 52*a* and fastened to the first half body 52*a* by means of a bolt 54. The big end 52 forms a bearing 55 for the crank pin 38 with the first half body 52*a* and the second half body 52*b*. Formed on the first half body 52*a* and the second half body 52*b* are receiving faces 57*b* and 57*a* respectively that receive a head of the bolt 54 and a nut 56 joined to the bolt 54. The receiving faces 57*b* and 57*a* are formed on a plane orthogonal to a virtual plane that includes the axis 48 of the linking shaft 47 and the axis 51 of the crank pin 38. Angular bodies 58*a* and 58*b* protruding angularly in the radial direction from the bearing 55 are therefore formed on the first half body 52*a* and the second half body 52*b* respectively.

The internal combustion engine 23 includes a pulser ring (to-be-detected body) 61 housed within the crank chamber 43 and fixed to the crankshaft 32. The pulser ring 61 is formed into an annular plate shape that is coaxial with the rotational axis Xc and rotates integrally with the crankshaft 32. The pulser ring 61 is integrated with the third crank web 42.

The pulser ring 61 includes a plurality of reluctors (gear teeth) 61*a* arranged at equal intervals in an annular shape around the rotational axis Xc. The reluctors 61*a* are disposed at intervals with a central angle of for example 10 degrees. The reluctor 61*a* is formed from for example a magnetic material.

The internal combustion engine 23 includes a pulser sensor (detection sensor) 62 mounted on an upper face of the crankcase 31 from the outside. The pulser sensor 62 projects from an outer face of the crankcase 31 so as to go away from the rotational axis Xc of the crankshaft 32. As shown in FIG. 4, the pulser sensor 62 is mounted on an upper portion of the crankcase 31 between a first vertical plane 63, including the rotational axis Xc of the crankshaft 32 and orthogonal to the cylinder axes Xf and Xr, and a portion of the cylinder block 33 defining the cylinder 33*a* at the rearmost position of the vehicle. The pulser sensor 62 is disposed in the crankcase 31 on the rear side of the vehicle. The pulser sensor 62 is made to face the annular trajectory of the pulser ring 61 and generates a pulse signal in response to movement of the pulser ring 61.

The pulser sensor 62 includes a main body 65 that is inserted into a through hole 64 formed in the crankcase 31 and faces the crank chamber 43 via a detecting part at the extremity, a connector 66 that is joined to the main body 65 and disposed in a space outside the crankcase 31, and a fastening piece 67 that is joined to the main body 65 and fastened to the outer face of the crankcase 31. The pulser sensor 62 outputs an electric signal in response to the existence of a magnetic material detected on the trajectory of the pulser ring 61. The pulser sensor 62 outputs a pulse signal that specifies an angular position of the crankshaft 32. Alternatively, the pulser sensor 62 may employ an eddy current type microdisplacement sensor.

The fastening piece 67 is superimposed on an upper face of a pedestal 68 projecting from the outer face of the crankcase 31 and fastened to the pedestal 68 by means of a bolt 69. In the pulser sensor 62 a detection axis 71 that has the highest sensitivity is directed toward the rotational axis Xc of the crankshaft 32.

The operation of this embodiment is now explained. In the present embodiment the pulser sensor 62 extends through the crankcase 31 from the upper face of the crankcase 31. Due to the pulser sensor 62 being mounted on the crankcase 31 the pulser ring 61 is separated from an outer rotor of a generator. In this way the influence of an electromagnetic force acting between the outer rotor and an inner stator is avoided. The angular velocity of the crankshaft 32 is detected with high precision. Moreover, since the crankcase 31 is sandwiched between the cylinder blocks 33 along a horizontal plane, the pulser sensor 62 is protected by the crankcase 31 and the cylinder block 33 from stones, etc. scattered up from the road surface. The pulser sensor 62 is prevented from being damaged. In addition, since the pulser sensor 62 is mounted from the outside of the crankcase 31, any increase in the dimensions of the crankcase 31 or a case cover can be avoided. On the other hand, if the pulser sensor 62 were to be disposed on the inside of the crankcase 31 or the case cover, it would not be possible to avoid an increase in the dimensions of the crankcase 31 or the case cover. An increase in the dimensions of the crankcase 31 or the case cover would cause a local increase in the weight of the internal combustion engine 23, thus degrading the weight balance of the internal combustion engine 23.

The pulser ring 61 is disposed between the pair of journals 37 and 37*a* positioned at the rearmost position of the vehicle within the crank chamber 43. The pulser sensor 62 is disposed on the radially outer side of the pulser ring 61. The pulser sensor 62 is thus disposed on the rear side of the vehicle with respect to the crankcase 31 and the cylinder block 33. Therefore, stones, etc. scattered up from the front of the vehicle when traveling are blocked by the crankcase 31 or the cylinder block 33 and do not reach the pulser sensor 62. Moreover, even when the number of cylinders increases and the length of the crankshaft 32 increases, in the internal combustion engine 23 with a horizontally-opposed arrangement, since vibration and flexure of the crankshaft 32 are suppressed, even if the pulser ring 61 is not positioned at a central position in the axial direction, the angular velocity of the crankshaft 32 can be detected with sufficient precision.

In the present embodiment the pulser ring 61 is integrated with the third crank web 42 of the crankshaft 32. The pulser ring 61 can therefore be incorporated into the internal combustion engine 23 without significantly changing the design. Moreover, the third crank web 42 is formed with a circular outline without having an opening of the oil passage 45 at the outer peripheral edge. The reluctor 61*a* can be disposed with good precision.

The pulser sensor 62 is mounted on the crankcase 31 in a space S sandwiched between the first vertical plane 63, including the rotational axis Xc of the crankshaft 32 and orthogonal to the cylinder axes Xf and Xr, and a second vertical plane 63*a* including an end, on the crankshaft 32 side, of the cylinder 33*a* positioned at the rearmost position of the vehicle. The big end 52 of the connecting rod 44 forms the bearing 55 for the crank pin 38 with the first half body 52*a* and the second half body 52*b*. When fastening the first half body 52*a* and the second half body 52*b*, the angular bodies 58*a* and 58*b* protruding angularly in the radial direction from the bearing 55 are formed on the big end 52. When the crankshaft 32 is rotating, compared with the angular body 58*a* of the first half body 52*a*, the angular body 58*b* of the second half body 52*b* approaches an inner wall face of the crankcase 31. In the present embodiment, since the pulser sensor 62 is disposed between the cylinder 33*a* and the vertical plane 63 including the rotational axis Xc, the pulser sensor 62 is kept away from the angular body 58*b* of the second half body 52*b*. Since sufficient space is ensured between the angular body 58*a* of the first half body 52*a* and the inner wall face of the crankcase 31 even when the crankshaft 32 is rotating, interference between the pulser sensor 62 and the connecting rod 44 is easily avoided.

The pulser sensor 62 includes the main body 65 inserted into the through hole 64 formed in the crankcase 31 and facing the crank chamber 43 via the detecting part at the extremity, the connector 66 joined to the main body 65 and disposed in the space outside the crankcase 31, and the fastening piece 67 joined to the main body 65 and fastened to the outer face of the crankcase 31. Since the pulser sensor 62 is merely inserted into the through hole 64 of the crankcase 31, the pulser sensor 62 can easily be fitted into the internal combustion engine 23. Furthermore, since it is fastened to the outer face of the crankcase 31 by means of the fastening piece 67, the pulser sensor 62 can reliably be fixed to the outer face of the crankcase 31.

The invention claimed is:

1. An internal combustion engine comprising a crankcase that defines a crank chamber, a crankshaft that has a crank housed in the crank chamber and is rotatably supported on the crankcase, a cylinder block that is joined to the crankcase and defines a plurality of cylinders in a horizontally-opposed arrangement, in each of the cylinders, respectively, a connecting rod that is linked to a piston housed in the cylinder via a small end thereof, and is linked to a crank pin of the crankshaft via a big end connected to the small end by a shaft part, a to-be-detected body that rotates integrally with the crankshaft, and a detection sensor that extends through the crankcase from an upper face of the crankcase, is made to face a trajectory of the to-be-detected body, and generates a pulse signal in response to movement of the to-be-detected body, wherein:

the crankcase has a pedestal projecting outwardly on an outer face thereof, the pedestal having a through hole formed therein and having an outer face, the detection sensor includes a main body that is received in the pedestal via the through hole, and the detection sensor is attached to the pedestal via a fastening piece and a fastener, the fastening piece being superimposed on the outer face of the pedestal, and wherein, when mounted on a vehicle, the detection sensor is mounted on the crankcase at a position which is higher than one cylinder that is at a rearmost position of the vehicle, and between the one cylinder and a vertical plane that includes a rotational axis of the crankshaft, and is orthogonal to a cylinder axis of the one cylinder.

2. The internal combustion engine according to claim 1, wherein when mounted on the vehicle, the to-be-detected body is disposed between a pair of journals at the rearmost position of the vehicle within the crank chamber, and the detection sensor is disposed on a radially outer side of the to-be-detected body while being directed toward a rotational axis of the to-be-detected body.

3. The internal combustion engine according to claim 2, wherein the to-be-detected body is integrated with a crank web of the crank.

4. The internal combustion engine according to claim 1, wherein the to-be-detected body is integrated with a crank web of the crank.

5. The internal combustion engine according to claim 4, wherein the crank web is formed so as to have a circular outline without having an opening of an oil passage on an outer peripheral edge thereof.

6. The internal combustion engine according to claim 5, wherein the big end of the connecting rod has a first half body that is continuous from the shaft part, and a second half body that sandwiches the crank pin between the second half body and the first half body and wherein the second half body is fastened to the first half body by a bolt.

7. The internal combustion engine according to claim 1, wherein the detection sensor comprises that the main body is inserted into the through hole formed in the crankcase and further faces the crank chamber via a detection part at an extremity thereof, wherein a connector is joined to the main body and is disposed in a space outside the crankcase, and the fastening piece is joined to the main body and is fastened to the outer face of the crankcase.

8. An internal combustion engine comprising:

a crankcase that defines a crank chamber, a crankshaft that has a crank housed in the crank chamber and is rotatably supported on the crankcase, a cylinder block that is joined to the crankcase and defines a plurality of cylinders in a horizontally-opposed arrangement, a to-be-detected body that rotates integrally with the crankshaft, and a detection sensor that extends through the crankcase from an upper face of the crankcase, is made to face a trajectory of the to-be-detected body, and generates a pulse signal in response to movement of the to-be-detected body, wherein, when mounted on a vehicle, the detection sensor is mounted on the crankcase between one cylinder that is at a rearmost position of the vehicle, and a vertical plane that includes a rotational axis of the crankshaft and is orthogonal to a cylinder axis of the one cylinder, and wherein:

the crankcase has a pedestal projecting outwardly on an outer face thereof, the pedestal having a through hole formed therein and having an outer face, the detection sensor includes a main body that is received in the pedestal via the through hole, and the detection sensor is attached to the pedestal via a fastening piece and a fastener, the fastening piece being superimposed on the outer face of the pedestal.

* * * * *